US006758259B1

(12) United States Patent
Holzgruber et al.

(10) Patent No.: US 6,758,259 B1
(45) Date of Patent: Jul. 6, 2004

(54) METHOD AND ARANGEMENT FOR PRODUCING CASTING MOULDS FROM METAL

(75) Inventors: Harald Holzgruber, Bruck (AT); Wolfgang Holzgruber, Bruck (AT)

(73) Assignee: Inteco Internationale Technische Beratung Ges.m.b.H., Mur (AT)

( * ) Notice: Subject to any disclaimer, the term of this patent is extended or adjusted under 35 U.S.C. 154(b) by 0 days.

(21) Appl. No.: 10/203,327

(22) PCT Filed: May 31, 2000

(86) PCT No.: PCT/EP00/04963

§ 371 (c)(1),
(2), (4) Date: Dec. 3, 2002

(87) PCT Pub. No.: WO01/58622

PCT Pub. Date: Aug. 16, 2001

(30) Foreign Application Priority Data

Feb. 7, 2000 (AT) ..... 182/2000

(51) Int. Cl.[7] ..... B22D 27/02
(52) U.S. Cl. ..... 164/470; 164/496; 164/497
(58) Field of Search ..... 164/469, 470, 164/495, 496, 497, 508, 509, 514, 515

(56) References Cited

U.S. PATENT DOCUMENTS 3,902,543 A * 9/1975 Longbottom ..... 164/470

* cited by examiner

*Primary Examiner*—Kuang Y. Lin
(74) *Attorney, Agent, or Firm*—Bachman & LaPointe, P.C.

(57) ABSTRACT

In a method of producing substantially segregation-free and in particular freckle-free castings of metal—in particular high-alloyed steels and Ni- and Co-based alloys of large dimensions in accordance with an electroslag melting or casting method—using a short electrically conductive water-cooled chill mold (10), in the wall of which current-conducting elements (6) which are not directly water-cooled are installed in electrically insulated relationship with the part of the chill mold (10) forming the casting, a substantially segregation-free and freckle-free bloom (24) of a cross-sectional area which is at most 90% of the part of the chill mold (10) forming the casting is arranged therein and connected to the supplied metal, using a slag bath (31) which is heated by the flow of current and which is disposed in the region of the current-conducting elements (16) by continually quantitatively controlledly pouring in liquid metal (34)—or by the supply of solid metal in the form of for example granules or bars which melts in the hot slag bath (31). The level of the slag (32) in the chill mold (10) is kept approximately constant by a relative movement between the chill mold (10) and the ingot (24) until the bloom (24) is radially doubled in the desired length. That operation is repeated with the double bloom (24) with a chill mold of larger dimension one or more times until the desired final dimension of the casting is achieved.

15 Claims, 3 Drawing Sheets

METHOD AND ARANGEMENT FOR PRODUCING CASTING MOULDS FROM METAL

BACKGROUND OF THE INVENTION

The invention concerns a method and an arrangement for producing castings.

In energy machine construction there is nowadays a trend to use stationary gas turbines with a high specific output as an alternative to the nuclear power stations which in many cases are rejected for environmental reasons, in which it was possible to manage with steam turbines. The higher working temperatures of gas turbines require the use of high-alloyed iron- and in particular nickel-based alloys which have considerable contents of Ti, Al, B, Nb, Ta, W etc in order to achieve the required properties. Hitherto gas turbines were preferably used as engines for aircraft, for which it was possible to manage with comparatively small turbine shafts. Relatively small ingots of diameters of 500 mm and below were required for the production thereof, which could be produced by means of re-melting methods with self-consumable electrodes, to afford an adequate quality standard. The term adequate quality standard is used in particular to denote a rough ingot which is substantially free from macroscopic textural and structural non-homogeneities such as segregation phenomena and other flaws which are known as 'freckles' and 'white spots'.

White spots are flaw locations which are depleted in respect of alloying elements in comparison with the rest of the material. That flaw phenomenon is only known from the vacuum electric arc method with self-consumable electrodes, and it is assumed that this flaw phenomenon is caused by dendrite branches which drop down from the electrode tip and which are not fused in the molten sump. In the case of the electroslag re-melting method with self-consumable electrodes, that flaw phenomenon has hitherto not been observed.

Freckles are spot-shaped or fleck-shaped segregation phenomena which occur in isolated form and which can occur upon hardening of high-alloyed ingots along the dendrites if the alloy contains elements whose density differs considerably from the density of the basic alloy. Accordingly iron- or nickel-based alloys which contain high contents of specifically light elements such as for example Ti or Al but also specifically heavy elements such as W, Nb, Ta are particularly susceptible to that flaw phenomenon. While in the case of ingots of smaller dimensions of up to about 400 to 500 mm ingot diameters that flaw occurs only in isolation and only under unfavourable re-melting conditions, the production of flaw-free ingots of larger diameter is as good as impossible, even with the best control of the re-melting conditions. This is to be attributed to the fact that the long hardening times and large sump volumes which are inevitable when producing large re-melting ingots on the one hand result in a coarse hardening structure while on the other they promote segregation phenomena.

Now however the construction of stationary gas turbines with a sufficiently high specific output requires large turbine shafts, for the production of which correspondingly large rough ingots of diameters of substantially over 500 mm, preferably up to 1000 mm, are again required. In accordance with the present state of the art in regard to re-melting with self-consumable electrodes sufficiently flaw-free rough ingots cannot be produced from the alloys required for that purpose.

DE-196 14 182 C2 discloses a short, water-cooled, downwardly open chill mold for producing ingots or blocks, in which a casting level is covered by an electrically conductive slag in which the block or ingot is shaped in the lower part and withdrawn therefrom either by lifting the chill mold or by lowering the block or ingot. At least one current-conducting element which is not directly water-cooled is fitted into the wall of the chill mold which is formed from water-cooled elements, in such a way that the current-conducting element on the one hand comes into contact with the slag bath and on the other hand does not reach the level of the liquid metal; contact with a current source is made by way of that element which is disposed completely beneath the surface of the slag bath.

U.S. Pat. No. 5,799,721 discloses a method of re-melting in particular steels and Ni- and Co-base alloys to form an ingot by melting away at least one self-consumable electrode in an electrically conductive slag bath, wherein the ratio of the cross-sectional area of one or more consumable electrodes to the cross-sectional area of the ingot to be produced as the casting cross-section is selected to be greater than 0.5 and a melting rate in kg/h which corresponds to between 1.5 and 30 times the ingot diameter is set; the equivalent ingot diameter which deviates from a round cross-section is calculated from the periphery of the casting cross-section. In a funnel chill mold the melting rate in kg/h corresponds to between 5 and 15 times the equivalent ingot diameter calculated from the periphery of the casting cross-section and the ratio of the cross-sectional area or areas of the consumable electrode or electrodes to the cross-sectional area of the casting cross-section is equal to or greater than 1.0, wherein the ingot is shaped in the lower narrow part of the funnel chill mold and the slag bath extends into the enlarged upper part thereof.

In a method of producing castings of metal in accordance with GB-A-1 568 746 the ESR chill mold is provided with electrically insulated water-cooled current-conducting elements. Solid metal in the form of granules is continuously fed to the slag bath in order to result in the casting of a bloom of any length. Granules of that kind are of a higher density in the solid condition both than the slag bath and also the liquid metal of the molten sump, with the result that granules of that kind fall very quickly through the hot slag and do not or only very partially melt there, by virtue of the short residence time. If unmelted particles pass into the liquid metal sump, they also drop there by virtue of their higher density to the phase limit. There however they no longer melt as there is no longer a sufficient supply of heat in that region. With advancing hardening, particles of that kind are then enclosed in the unmelted condition in the form of foreign metal inclusions of their own specific kind in the hardening structure. As such unmelted particles are of a different structure—and thus involve different properties—from the melted metal, they are unwanted in melted ingots of which a uniform, fine and fault-free hardening structure is required.

It is an object of the present invention to provide a method for producing substantially segregation-free and in particular freckle-free castings of metal, in particular high-alloyed steels and Ni- and Co-based alloys of large dimension in accordance with the electroslag melting or casting method using a per se known short, current-conducting, water-cooled chill mold, in the wall of which current-conducting elements which are not directly water-cooled are fitted in electrically insulated relationship with the part of the chill mold, which forms the casting.

SUMMARY OF THE INVENTION

The foregoing object is attained by the teaching of the independent claim; the appendant claims set forth advantageous developments. The scope of the invention also embraces all combinations of at least two of the features disclosed in the description, the drawing and/or the claims.

In accordance with the invention a substantially segregation-free and freckle-free bloom whose cross-sectional area is at most 90% of the part of the chill mold forming the casting is arranged therein and, using a slag bath which is heated by the flow of current and which is disposed in the region of the current-conducting elements of the chill mold, by continually quantitatively controlledly pouring in liquid metal is connected to the supplied metal; the level of the slag in the chill mold is kept approximately constant by a relative movement between the chill mold and the bloom until the bloom is radially doubled in the desired length—that is to say is surrounded by a cast casing or jacket layer—; that operation can be repeated with the doubled bloom with a chill mold of larger dimension one or more times until the desired final dimension of the casting is reached. The method is basically suitable for any cross-sectional shapes. If however rough ingots which are subjected to further processing by forging are required, then round ingots are most appropriately produced.

When carrying out the method it is important that the casting or melting speed respectively is so set that the sump depth resulting therefrom permits upwardly directed, segregation-free hardening. It has proven to be desirable for the average casting or melting speed to be so set in kg/hour that it is between 0.25 and 5 times the sum of the equivalent bloom diameter and chill mold diameter in mm, wherein the equivalent diameter for shapes differing from round cross-sections is determined by the quotient periphery/$\pi$. In the case of extremely segregation-sensitive alloys, the best results are achieved if the casting or melting speed is set in the range of between 0.8 and 1.5 times the sum of the equivalent diameter corresponding to the above-indicated relationship.

The bloom required for carrying out the method is preferably produced by a re-melting method with a self-consumable electrode, in which case here a bloom dimension is selected, which ensures a fine-grain structure and with which the occurrence of freckles and segregation phenomena can be certain to be avoided. Basically the bloom can also be produced by an electroslag or other casting method as long as adequate freedom from freckles and segregation is guaranteed.

In the case of crack-sensitive alloys—and also for good and flaw-free bonding between the bloom and the doubled layer—it may be desirable to preheat the bloom to a temperature of up to 800° C. For the production of homogeneous freckle-free and segregation-free ingots and castings for the production of forged components or the like the bloom is doubled with an alloy which is of the same chemical composition as the bloom. For particular purposes of use—for example the production of composite rollers which must have a tough core and a wear-resistant surface—the bloom can also be doubled with an alloy of completely different composition.

For the purposes of carrying out the method it is necessary that the liquid slag bath is always disposed at the height of the current-conducting elements which are installed in the wall of the chill mold and which are not directly water-cooled and which are electrically insulated with respect to the rest of the chill mold, as it is by way of those elements that current can be fed into the slag bath. The return of the current is then effected by way of the bloom or the bottom plate on which the bloom rests. Due to the flow of current therethrough, the slag bath is maintained in a liquid condition and heated to such an extent that on the one hand the metal of the bloom begins to melt at its surface and on the other hand, even when liquid metal is slowly poured in, for the purposes of the doubling effect, premature hardening is avoided at the location where the meniscus of the liquid level of metal is in contact with the water-cooled wall of the chill mold.

For starting the procedure the prepared bloom is put on to a stool which fits into the internal opening of the chill mold and which can either be water-cooled—and thus re-usable—or which can also comprise the same material as the bloom. The stool with the bloom carried thereon is firstly positioned in the chill mold in such a way that its upper edge just terminates with the upper edge of the lower, water-cooled part of the chill mold which forms the new surface of the bloom. Voltage is now applied, in which case however initially still no current flows as there is no conducting connection between the current-conducting elements and the bloom or the bottom plate. Then a pre-melted slag of the desired composition is poured into the gap between the bloom and the wall of the chill mold, whereby a current begins to flow as soon as the level of the slag passes into the region of the current-conducting elements in the wall of the chill mold. Now the desired electrical power is set to correspond to the dimensions of the bloom and the chill mold and after a short time which is sufficient to initiate melting of the surface of the bloom which is exposed to the slag bath, the operation of pouring in the metal which is to form the doubled layer is begun. In order always to keep the level of the slag in the region of the current-conducting elements, depending on the configuration of the installation—for example with a stationary stool—the chill mold is raised continuously or in steps approximately as the level of the slag rises due to the supply of metal. If in contrast the installation has a stationary chill mold the stool is withdrawn from the chill mold in a corresponding fashion in order in that way once again to ensure an approximately constant level for the slag in relation to the current-conducting elements. In this respect the operation of pouring in liquid metal can be effected continuously or discontinuously in steps, according to the desired speed of formation. When using a stepwise supply however the volume of the amount of metal in an individual step is not to exceed the volume of the slag bath. Both when using a continuous and also a stepwise supply of metal however care is to be taken to ensure that the above-mentioned mean casting rate is not exceeded.

The lifting movement of the chill mold or the lowering movement of the bottom plate with the stool can be effected in per se known manner again continuously or in steps, in which respect the mean lifting or withdrawal speed must again be suitably matched to the metal supply speed. When adopting a stepwise mode of operation, it is to be noted that the individual step is not to be greater than the height of the current-conducting elements which are installed in the wall of the chill mold. Each lifting step is followed by a pause until the level of the slag has again approximately reached the original level. When using a stepwise mode of operation, a return stroke can further be incorporated between the withdrawal step and the pause, in which case then the withdrawal stroke, the return stroke and the pause must be so matched to each other that they correspond to the mean metal supply speed.

If in contrast operation is implemented with a continuous withdrawal speed, it may be helpful, to afford a good surface, if the chill mold performs an oscillating movement, as is known from continuous casting.

It is to be considered as a further essential feature that the casting which rests on a lowerable bottom plate is withdrawn from the fixedly installed chill mold in such a way that the level of the slag bath in the chill mold remains approximately constant. In addition the operation of pouring in the liquid metal or melting the added solid metal pieces is preferably effected under a protective gas atmosphere of controlled composition and controlled pressure; the controlled reduced pressure is set in the range of between 1 and 600 mbar, while in the case of an increased pressure a value of more than two bars is preferred.

Instead of pouring in liquid metal, solid metal can also be introduced into the slag bath in the form of bars, chips or turnings or granules and caused to melt therein. The supply of metal into the gap between the bloom and the chill mold is continued in the above-described manner until the entire bloom has been doubled thereon. Then the supply of energy to the slag bath is switched off and the doubled bloom is removed from the installation, after complete hardening of the doubled layer.

In principle the method can be carried out in the open air as the liquid slag bath protects the level of metal therebeneath, from the oxygen in the air. For the production of high-grade alloys however it is recommended that the method be carried out under a controlled protective gas atmosphere, in which case it is also possible to operate under a reduced pressure or an increased pressure, depending on the respective demands involved.

In an arrangement according to the invention for producing castings with a low degree of segregation and in particular a low degree of freckling of metal—in particular steels and Ni- and Co-based alloys in accordance with an electoslag melting or casting method—with a short, current-conducting, water-cooled chill mold, in the wall of which current-conducting elements which are not directly water-cooled are installed in electrically insulated relationship with the part of the chill mold which forms the casting, and which is provided with a bottom plate associated downwardly with the chill mold, for carrying out the described method, a casting gap for receiving liquid metal is delimited by a bloom placed on the bottom plate and the chill mold. Two chill molds which are connected in succession are preferred; in that case the inside diameter of the subsequently connected chill mold should be larger than that of the preceding chill mold.

BRIEF DESCRIPTION OF THE DRAWINGS

Further advantages, features and details of the invention will be apparent from the description hereinafter of preferred embodiments and with reference to the drawings where.

DETAILED DESCRIPTION

Figure 1:
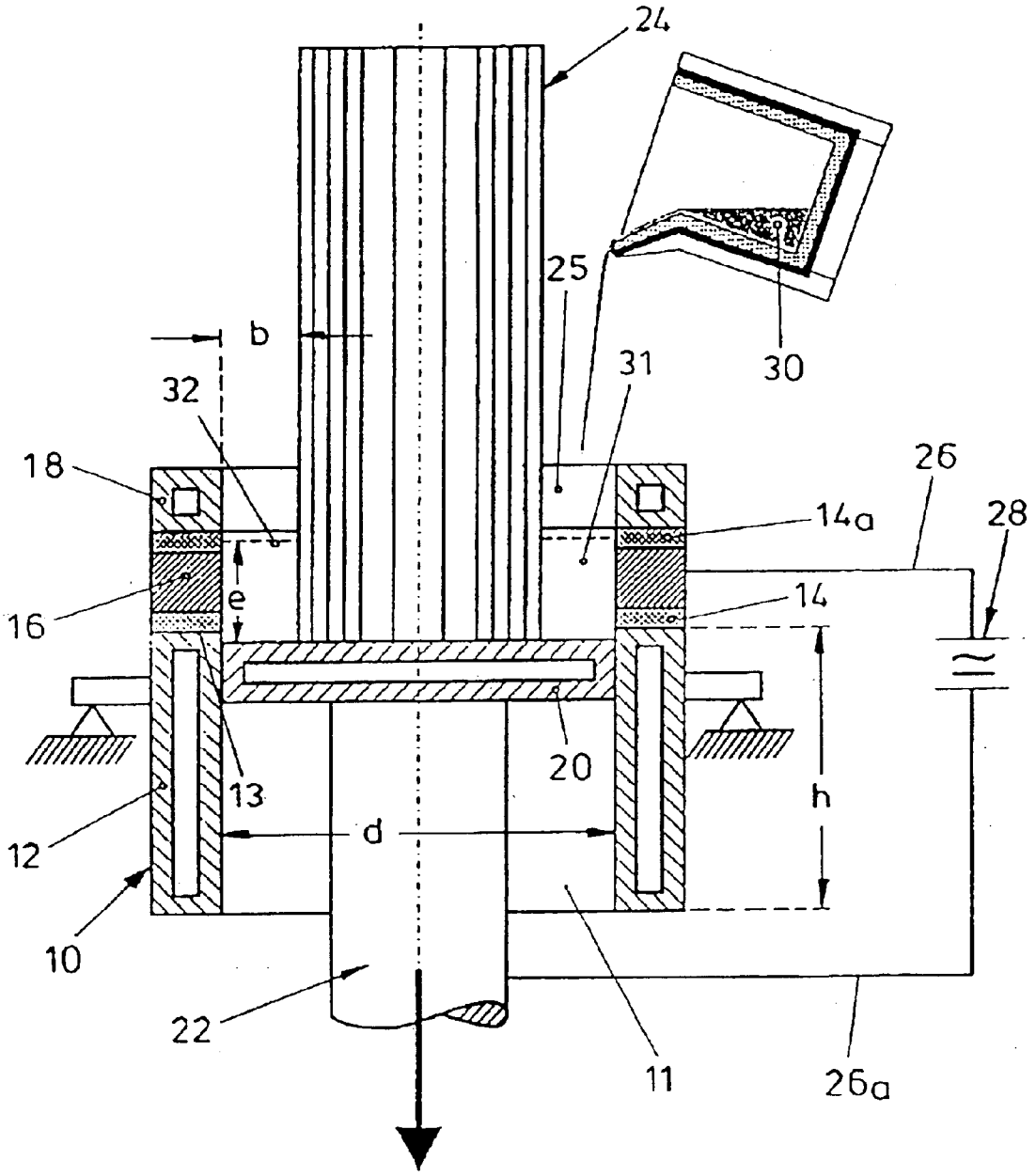
FIG. 1 is a longitudinal section through a water-cooled chill mold.

Referring to FIG. 1, inserted from below into a water-cooled chill mold 10 with an annular hollow body 12 is a bottom plate 20—which in turn is hollow—and which is part of a stool 22. The outside diameter of the bottom plate 20 is slightly shorter than the inside diameter d of the chill mold 10; to start the installation the bottom plate 20 can be pushed into the opening or the internal space 11 of the chill mold, of a height as indicated at h, until it is arranged immediately below the upper edge 13 of the hollow body 12 of the chill mold.

An annular insulating element 14 rests on the upper edge 13 and a current-conducting element 16 which is also of an annular configuration rests on the insulating element 14; the current-conducting element 16 is separated upwardly by an upper insulating element 14*a* from a hollow ring 18 which in turn is water-cooled.

A bloom 24 which is produced for example by a re-melting procedure with self-consumable electrode rests on the bottom plate 20 of the stool 22, which has been moved into a position near the upper edge 13 of the lower water-cooled part of the chill mold 10, for the starting operation. The bloom 24, with the chill mold 10, delimits a casting gap 25 of a width b.

The current-conducting element 16 and the stool 22 are connected by way of heavy-current lines 26, 26*a* to respective poles of a direct or alternating current source 28. In order to start the procedure liquid slag is poured out of a vessel into the chill mold gap delimited by the chill mold 10 and the bloom 24 until a level of slag 32 of a resulting slag bath 31 of a height e has approximately reached the upper edge of the current-conducting element 16.

Figure 2:
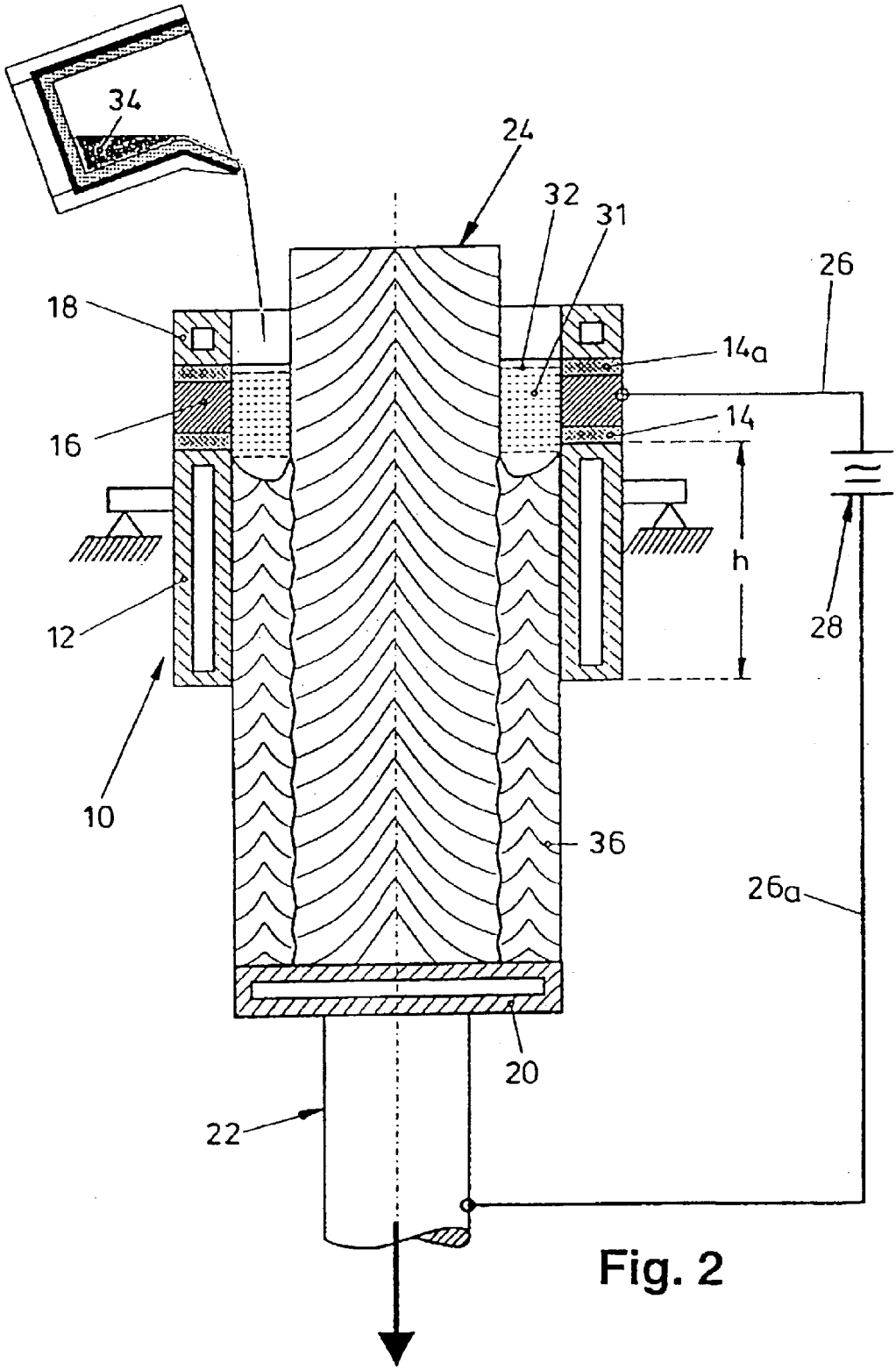
FIG. 2 is a view of the mold of FIG. 1 filled with metal.

Then, as diagrammatically shown in FIG. 2, liquid metal 34 is continuously poured through the slag bath 31 at the prescribed pouring speed, in which case the latter is on the one hand welded to the bloom 24 and on the other hand hardens in contact therewith and with the lower water-cooled part of the chill mold and forms a doubled jacket or casing layer 36 which is fixedly connected to the bloom 24.

Figure 3:
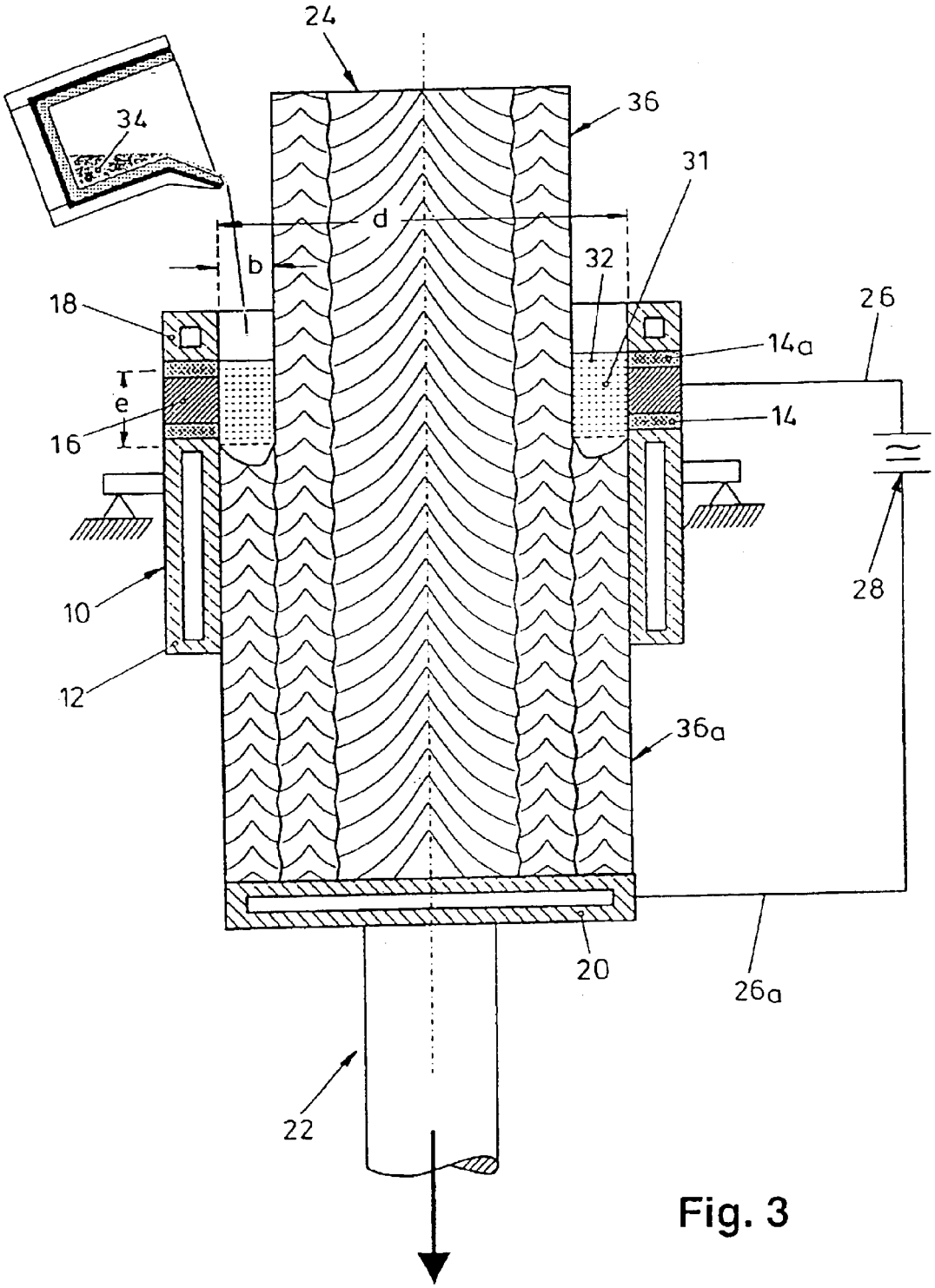
FIG. 3 is a view similar to FIG. 2 showing renewed radial doubling of a bloom.

FIG. 3 diagrammatically shows renewed radial doubling of a bloom 24 which has already been doubled once, by the application of a further doubled layer $\mathbf{36}_a$, in a chill mold of larger inside diameter d.

The effectiveness of the method according to the invention will now be illustrated by reference to the following example:

The Ni-base alloy Inconel 718 which has good high-temperature characteristics, besides the alloying elements Cr and Mo, also contains 0.9% of each of Ti and Al and over 5% of Nb and also B. The alloy is extremely freckle-sensitive so that qualitatively satisfactory ingots both in accordance with the electroslag remelting method and also in accordance with the vacuum arc re-melting method can be produced reliably only up to ingot diameters of about 450 mm. For building stationary gas turbines however ingots comprising that alloy of a weight of between 12 and 18 t and an ingot diameter of between 900 and 1000 mm would be required.

For the production of a rough ingot of a weight of 16.5 t with an ingot diameter of 950 mm, an electroslag re-melting installation with a standing crucible was used to re-melt a consumable electrode of a diameter of 340 mm and a length of 4 mm in a standing chill mold with an inside diameter of 420 mm at a melting rate of 350 kg/h to give an ingot of a length of 2.6 m. The chemical composition of the consumable electrode was 0.03% C, 0.18% Si, 0.21% Mn, 19.15% Cr, 2.97% Mo, 52.83% Ni, 0.89% Ti, 0.92% Al, 5.26% Nb, 0.0042% B and 17.85% Fe. A slag with 70% $CaF_2$ and 15% of each of $Al_2O_3$ and CaO was used for the re-melting procedure. The slag bath height e was set to 14 cm and the power feed to the slag bath 31 was kept in the range of between 350 and 380 kW with a melting current of between 9.0 and 10.0 kA. The re-melting duration was just 10 hours, of which about 25 minutes was involved in starting, about 8 hours 45 minutes for block formation and just 50 minutes for hot topping. After the re-melting operation the ingot was cooled down and removed from the chill mold. The ingot had a smooth surface and in the cold condition was 404 mm in diameter. Its weight was 3060 kg.

The bloom 24 produced in that way was then placed in an electroslag re-melting installation with downwardly movable bottom plate 20 on the water-cooled bottom plate chair 22 of a current-conducting chill mold 10 of an inside diameter d of 700 mm and the upper edge of the chair 22 was raised to just below the upper edge of the lower water-cooled part 12 of the chill mold 10 which is fixedly installed in the working platform. The main switch of the power supply was then switched on and the voltage set to 70 V, in which case still no current was measured. Then about 70 kg of liquid slag of the composition 70% $CaF_2$ and 15% of each of $Al_2O_3$ and CaO was then poured into the gap between the bloom 24 and the chill mold 10, whereupon a current of initially between about 2.5 and 3.0 kA began to flow, which then rose within about 10 minutes to between 9.0 and 9.8 kA, whereby a power of about 690 kW was also attained. A first portion of liquid metal 34 was now poured into the gap between the bloom 24 and the chill mold 10, which had been melted in a vacuum induction furnace of a 6 t capacity from cast sticks, which originated from the same melt as the consumable electrode of the bloom 24 and which were thus of the same chemical composition. The amount of the first portion was 15 kg, whereby the slag level 32 rose by not quite 7 mm. Thereby a first withdrawal step of a dimension of 3.5 mm was triggered off, which was followed after a second pause by a further withdrawal step also of 3.5 mm. One minute after the first portion a further portion of 15 kg was poured in, in which case the rise in the level of the bath again triggered off a withdrawal step of 3.5 mm which was followed after 30 seconds by a further withdrawal step. That procedure was continued, with the electrical power being maintained, until the upper end of the bloom 24 was reached after 6 hours and 25 minutes. After a post-cooling time of 25 minutes the doubled bloom 24 was taken from the installation. It had a satisfactory smooth surface with slight slag adhesions thereon and was now of a weight of 8810 kg, with a diameter of 690 mm.

That doubled bloom 24 was then introduced into a current-conducting chill mold 10 of a working diameter of 965 mm and the above-described operation of doubling or cladding was repeated once again, in which case the following parameters were adopted. 95 kg of liquid slag of the same composition was used. With a voltage of 60 V the current rose from 3.5 kA to 17.0 kA after the slag was poured in, within 12 minutes, with the power set being 1020 kW. Each minute, portions of liquid metal 34 of the same chemical composition each weighing 24 kg were poured in, and the downward movement was again effected every 30 seconds, in which respect the individual downward stroke steps were 3.9 mm. That procedure was again continued until the entire length had been doubled—after 5 hours 35 minutes. After a post-cooling time of again 25 minutes, the bloom was lifted out of the installation. It was of a diameter of just over 9050 mm and weighed 16740 kg. The bloom surface was sufficient for the bloom to be directly subjected to further processing by forging.

The bloom was therefore heated in a hearth-type bogie furnace to the forging temperature and then pre-forged on a 4500 t forging press to a diameter of 600 mm. With that dimension the forging blank was allowed to cool and subjected to diameter turning. In an ultrasonic testing procedure after the turning operation it was not possible to find any flaw indications. The ultrasonic testing procedure however afforded indications of coarse grain, which however did not adversely affect use as a further hot working operation was provided.

The bar was then divided into two portions of approximately equal length, thus affording the possibility of taking a disk for further investigations, from the center of the bloom. That disk was ground and subjected to a hot etching testing procedure. In that case it was possible to show that the disk was free of bloom segregation and in particular freckle segregation over the entire cross-section of the bloom. Bonding of the doubled layers was satisfactory at all locations. The structure in the doubled layers was markedly finer than that in the original bloom. All in all a disk exhibited an excellent structure and appeared entirely suitable for use for rotating turbine members of large dimensions.

What is claimed is:

1. A method for producing metal castings characterized by low levels of metal segregation of freckling comprising:

(a) providing a water-cooled chill mold;

(b) positioning a bloom having a first diameter in the water-cooled chill mold, wherein the bloom defines with the water-cooled chill mold a casting gap;

(c) selectively supplying metal which composition is substantially the same as that of bloom to the casting gap;

(d) locating current conducting element in a portion of the water-cooled chill mold;

(e) applying current to the current conducting elements, wherein a slag bath of the metal is provided in the casting gap; and (f) moving one of the bloom and the chill mold relative to each other wherein the level of the slag bath is maintained substantially constant wherein the diameter of the bloom is enlarged to a second diameter greater than the first diameter; and (g) positioning the bloom having a second diameter into a further water-cooled chill mold and repeating step (b) through (f) to obtain a bloom having a third diameter which is greater than the second diameter.

2. A method for producing metal castings characterized by low levels of metal segregation of freckling comprising:

(a) providing a water-cooled chill mold;

(b) positioning a bloom of an alloy composition having a first diameter in the water-cooled chill mold, wherein the bloom defines with the water-cooled chill mold a casting gap;

(c) selectively supplying metal which composition is substantially the same as that of bloom to the casting gap;

(d) locating current conducting element in a portion of the water-cooled chill mold;

(e) applying current to the current conducting elements, wherein a slag bath of the alloy composition is provided in the casting gap; and (f) moving one of the bloom and the chill mold relative to each other wherein the level of the slag bath is maintained substantially constant wherein the diameter of the bloom is enlarged to a second diameter greater than the first diameter.

3. A method as set forth in claim 2 wherein at least one repetition of the method with bloom of second diameter is carried out in a chill mold of larger diameter until a predetermined final diameter of a casting is produced.

4. A method as set forth in claim 2 or 3, wherein the average casting or melting speed in kg/hour is set between 0.20 and 5 times the sum of the equivalent bloom diameter and chill mold diameter, wherein the equivalent diameter is determined by the quotient periphery/$\pi$.

5. A method as set forth in claim 4, wherein the casting or melting speed in kg/hour is between 0.80 and 1.5 times the sum of the equivalent bloom diameter and the chill mold diameter.

6. A method as set forth in claim 1 or 2, wherein the bloom of second diameter has a substantially low level of segregation and is substantially free from freckle and is produced by a re-melting method with self-consumable electrode.

7. A method as set forth in claim 1 or 2, wherein the bloom of second diameter has a substantially low level of segregation and is substantially free from freckle and is produced by electroslag casting.

8. A method as set forth in claim 1 or 2, wherein the bloom of first diameter is preheated to a temperature of at most 800° C.

9. A method as set forth in claims 1 and 2, wherein the relative movement between the casting and the chill mold is produced by lifting the chill mold.

10. A method as set forth in claims 1 and 2, wherein the bloom rests on a lowerable bottom plate which is withdrawn from the chill mold such that the level of the slag bath in the chill mold remains substantially constant.

11. A method as set forth in claims 1 and 2, wherein the metal is provided under a protective gas atmosphere of controlled composition and controlled pressure.

12. A method as set forth in claim 11, wherein the controlled pressure is set in the range of between 1 and 600 mbar.

13. A method as set forth in claim 11, wherein the controlled pressure is set in the range above 2 bars.

14. A method as set forth in claim 1 or 2, wherein relative movement is effected in individual steps with a subsequent pause.

15. A method as set forth in claim 1 or 2, wherein during relative movement between the casting and the chill mold the latter is moved oscillatingly.

* * * * *